US008413797B2

(12) United States Patent
Soloman

(10) Patent No.: US 8,413,797 B2
(45) Date of Patent: Apr. 9, 2013

(54) SEGMENTED SLAT

(76) Inventor: Sabrie Soloman, Saddle River, NJ (US)

( * ) Notice: Subject to any disclaimer, the term of this patent is extended or adjusted under 35 U.S.C. 154(b) by 0 days.

(21) Appl. No.: 12/830,040

(22) Filed: Jul. 2, 2010

(65) Prior Publication Data

US 2012/0024806 A1 Feb. 2, 2012

(51) Int. Cl.
*B65G 47/00* (2006.01)

(52) U.S. Cl.
USPC ..... 198/803.13; 53/493; 221/76; 221/131

(58) Field of Classification Search ..... 53/493, 53/151, 244, 250; 221/76, 131, 160; 165/135, 165/185; 198/803.13, 803.14, 80.14, 850, 198/380, 867.15, 867.11
See application file for complete search history.

(56) References Cited

U.S. PATENT DOCUMENTS 3,670,865 A * 6/1972 Garland ..... 198/393
3,931,884 A * 1/1976 Ackley ..... 198/380
5,625,229 A * 4/1997 Kojima et al. ..... 257/712
5,988,364 A * 11/1999 Boyce et al. ..... 198/867.15
6,905,645 B2 * 6/2005 Iskra ..... 264/128
7,009,290 B2 * 3/2006 Bock et al. ..... 257/712
7,595,989 B2 * 9/2009 Liu ..... 361/700
8,020,259 B2 * 9/2011 Ho et al. ..... 24/129 R
8,220,619 B2 * 7/2012 Ackley ..... 198/803.13
2002/0113076 A1 * 8/2002 Collins et al. ..... 221/76
2003/0209342 A1 * 11/2003 Hsin et al. ..... 165/80.3

* cited by examiner

*Primary Examiner* — Korie H Chan
(74) *Attorney, Agent, or Firm* — Marc Lowy

(57) ABSTRACT

A slat segment is disclosed for use in packaging machines which dispense discrete pharmaceuticals, vitamin, or food products into containers. The slat segment is comprised of a straight elongated bar, whose first surface contains a plurality of substantially cylindrical cavities separated by adjacent walls. Discrete products ready for packaging are deposited into contoured intake flutes which guide the pharmaceuticals, vitamin, or food products into the cavities within the slat segment. The products are then dispensed from the slat segment via contoured disposal flutes connected to each cavity, to eventually be deposited into containers being conveyed proximate the packaging machine. Salient thermal radiation blocks are arranged along a second surface of the slat segment, along with thermal radiation webs, which facilitate conduction of thermal radiation away from the slat segment. The slat segment thereby maintains maximum strength and stability and minimizes necessary maintenance of the slat.

11 Claims, 8 Drawing Sheets

SEGMENTED SLAT

CROSS-REFERENCE TO RELATED APPLICATIONS (Not Applicable.)

STATEMENT REGARDING FEDERALLY SPONSORED RESEARCH AND DEVELOPMENT (Not Applicable.)

FIELD OF THE INVENTION

This invention relates to slats utilized in packaging machines, and more particularly to a segmented slat utilized for dispensing discrete pharmaceutical, vitamin, or food products into containers.

DISCUSSION OF RELATED ART

Certain industries, such as pharmaceutical industries, utilize automated packaging apparatus to count, inspect and package predetermined quantities of discrete dosage items such as capsules and tablets. Such automated packaging apparatus typically employ various types of slats, typically rotating in unison, to receive discrete products and then dispense them in predetermined quantities into containers.

Insuring the exact accuracy of the claimed product count of the dispensed products is a paramount requirement in pharmaceutical packaging equipment.

Several prior art devices are known which utilize various types of packaging slats.

Traditional slats used in the pharmaceutical and vitamin industries consist of elongated bars that may extend up to four or five feet. Each slat contains many cavities inserted along the centerline of the slat. A slat may contain either single or double rows of cavities. Typically each packaging machine may utilize a minimum of 72 slats, rotating in unison, all of them designed for one specific product. There typically are an average of 25 different products which may be dispensed from each machine. The total number of possible slats utilized by each machine is thus considerable. Often a cavity or multiple cavities within the slat may be damaged or destroyed. The entire elongated slat is then rendered useless and must be replaced, resulting in significant expenditure of money and materials.

For various reasons a slat may become twisted along its length, resulting in significant manufacturing problems, including:

1. Misalignment of the cavities, causing the dispensed products to jam the receiving mechanisms of the products, 2. Products may not be dispensed relatively at the same time into their containers leading to an inaccurate product count in the containers, thus causing substantial legal issues for suppliers and consumers, 3. Inaccurate counts in any container constitute an FDA violation subject to substantial penalties.

Significant manual labor may be required to correct any twists in a slat. Typically a specialist manually applies a flame to release thermal stress which occurred during the original molding operation of the slat. This heating process must be repeated several times until the slat becomes straight within acceptable tolerances. Mechanical gauges and measuring tools are utilized to ensure the slat's straightness and parallelism. This whole process must be repeated several times for each slat in the packaging apparatus, until all slats reach acceptable metrological dimensions The present invention is a slat segment approximately 1/10th of the length of a traditional slat. Each slat segment is a mirror image of the adjacent segment. When approximately ten slat segments are connected longitudinally into one segmented slat, they will function exactly as the single traditional slat does. However, the ten segmented slats will operate with exceptional accuracy and will be free from any twists and dimensional distortions.

Each slat segment contains an equal number of cavities. Each slat segment is divided by the walls of the cavities at the ends of the slat. Therefore, the cavities of either type of slats are maintained whole and undivided.

Clearly there is a need for a slat segment which will not be subject to the twisting and distortion problems occurring in existing slats. Such a slat would reduce or eliminate the manual labor and expenses required to correct the twisting and distortion of the present slats. The slat thereby reduces wasted materials and unnecessary costs. The present invention accomplishes these objectives.

SUMMARY OF THE INVENTION

The present invention is directed to a slat segment for dispensing discrete pharmaceutical, vitamin, or food products into various types of containers being conveyed proximate to the slat segment. The containers include but are not limited to bottles, jars, boxes, and the like. The discrete products may comprise but are not limited to tablets, capsules, caplets, vitamins, pills, and the like.

The slat segment is approximately 1/10th the length of a traditional slat. Each slat segment is a mirror image of the adjacent segment. When approximately ten slat segments are placed longitudinally side by side, they will function exactly as the single traditional slat does. However, the ten slats will operate with exceptional accuracy and will be free from any twists and dimensional distortions.

The slat segment is comprised of a straight elongated bar, whose first surface contains a plurality of substantially cylindrical cavities separated by adjacent walls. Each slat segment may be pre-configured with a specific quantity of cavities, and a specific quantity of blank cavities. The quantity of products to be dispensed into each container is controlled by both the total number of cavities installed in the packaging machine, along with the total number of blank cavities configured in the segmented slats.

During operation of a packaging apparatus which utilizes the invention, the segmented slats may be rotating continuously. Pharmaceutical, vitamin, or food products ready for packaging are deposited into contoured intake flutes of the slat segment. These intake flutes guide the pharmaceutical, vitamin, or food products into the cavities within the slat segment, so that each cavity will hold either one product, or else a predetermined number of products stacked automatically on top of each other constituting the desired number of products in a single cavity. Any excess products cannot remain above the filled cavities due to the cavities' unique configurations, which only permit a specific number of products to fill the cavities.

When the correct number of cavities have been filled with products, the products are then dispensed from the slat segment via contoured disposal flutes connected to each cavity. The products are eventually deposited into containers being conveyed proximate a packaging apparatus. Each container thereby receives a predetermined quality and quantity of pharmaceutical, vitamin, or food products.

A plurality of adjacent, salient, substantially solid thermal radiation blocks are arranged along a second surface of the slat segment. The distal ends of each thermal radiation block comprise a thermal radiation web which facilitates conduction of thermal radiation away from the slat segment. In one embodiment of the invention, the thermal radiation webs are substantially trapezoidal in shape to provide maximum thermal conductivity and rigidity.

Each thermal radiation block is laterally connected to an adjacent thermal radiation block by a thermal radiation rib. Thermal radiation grooves run vertically along the wall of each thermal radiation block, thereby increasing thermal radiation and allowing the entire slat segment to cool quickly, and maintain dimensional stability. Rigid reinforcing ribs run vertically along the wall of each thermal radiation block to provide additional strength and stability to the slat segment.

In one embodiment of the invention, a plurality of slat segments are connected longitudinally into one combined slat by stabilization pins extending from the first and second ends of each slat segment. In this embodiment each slat segment contains approximately ten cavities. In other embodiments of the invention, the slat segments may be comprised of polyethylene, ultra high molecular weight polymer (UHMW), aluminum, steel, or glass.

While a particular form of the invention has been illustrated and described, it will be apparent that various modifications can be made without departing from the spirit and scope of the invention. For example, the quantity of slats or the quantity of slat cavities, could be adjusted to various values, as well as the shape and the configurations of cavities. Accordingly, it is not intended that the invention be limited, except as by the appended claims.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The present invention will now be described more fully with reference to the accompanying figures. Although the accompanying figures show preferred embodiments of the invention, the invention may be embodied in many different forms and should not be construed as limited to the embodiments described herein.

Figure 1:
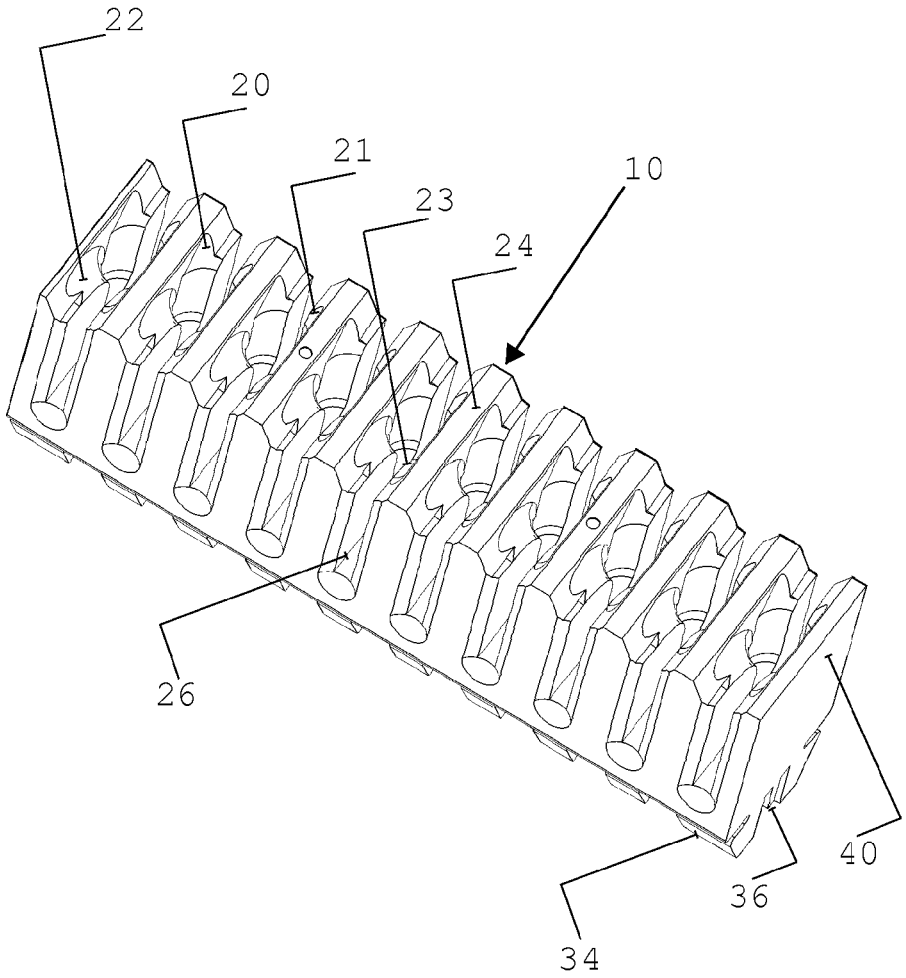
FIG. 1 is a Top Perspective View of the invention, illustrating a slat segment.

Turning to FIG. 1, the present invention is directed to a slat segment 10 for dispensing discrete pharmaceutical, vitamin, or food products into various types of containers being conveyed proximate to the slat segment 10. The containers include but are not limited to bottles, jars, boxes, and the like. The discrete products may comprise but are not limited to tablets, capsules, caplets, vitamins, pills, and the like.

As shown in FIG. 1, the slat segment 10 is comprised of a straight elongated bar, whose first surface contains a plurality of substantially cylindrical bifurcated cavities 26 separated by adjacent walls 24. Each bifurcated cavity 26 includes an involute cavity entry 21 and an involute cavity exit 23 configured to facilitate entry into the bifurcated cavity 26 and exit from the bifurcated cavity 26 of discrete product units. Near the second (lower) surface of the slat segment a thermal radiation web 34 is shown. A stabilization pin 36 extends from the first end of the slat segment 10 for the purpose of stabilizing the slat segment's connection to an adjacent slat segment. Also shown is a flat cavity wall 40.

Figure 3:
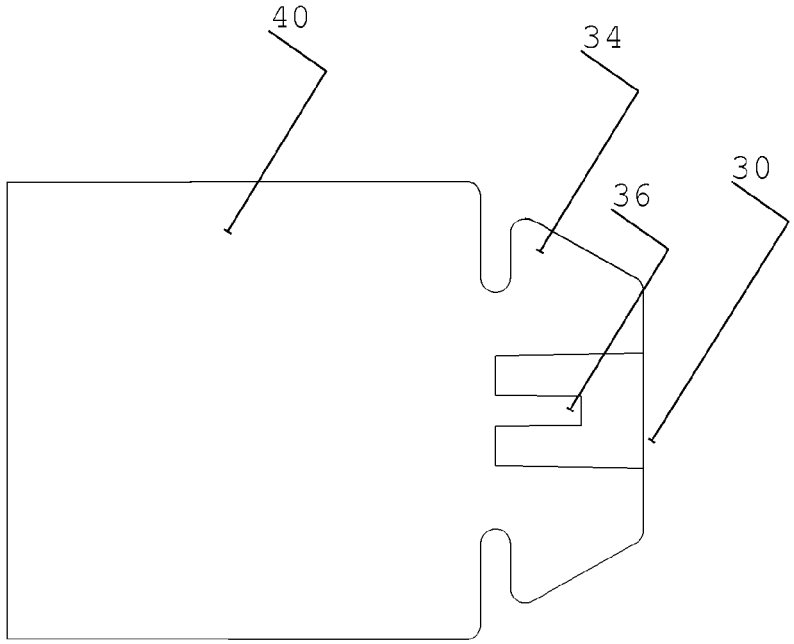
FIG. 3 is a Sectional View of the invention, illustrating a slat segment.

FIG. 3 illustrates a sectional view of a segmented slat 10, including a substantially solid thermal radiation block 30, a thermal radiation web 34, a stabilization pin 36, and a flat cavity wall 40.

Figure 4:
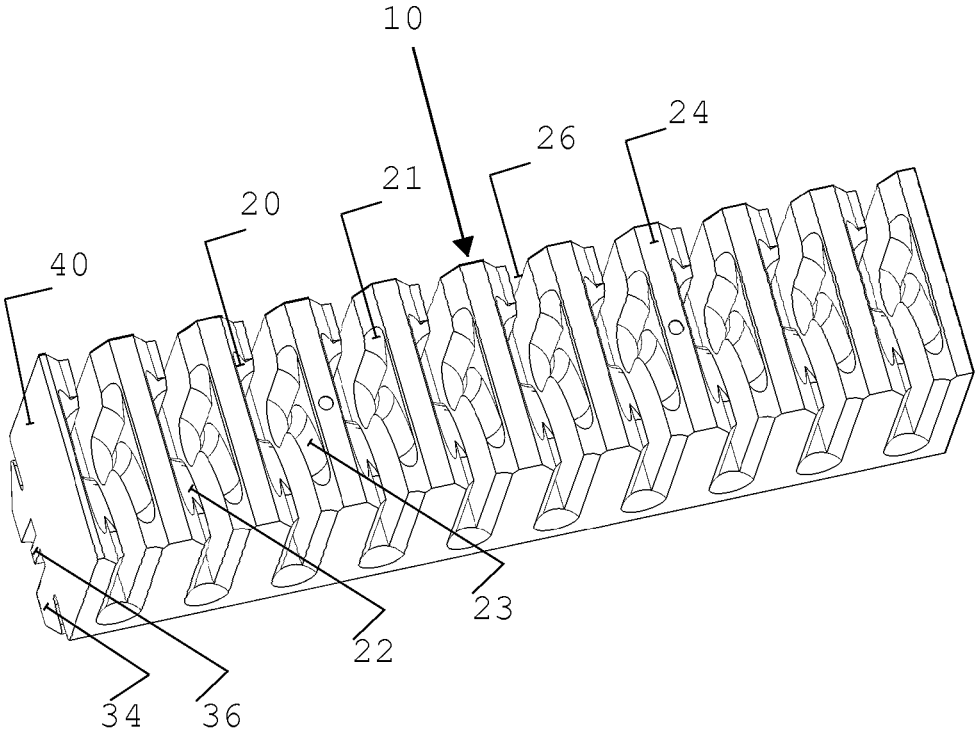
FIG. 4 is a Side Perspective View of the invention, illustrating a slat segment.
Figure 6:
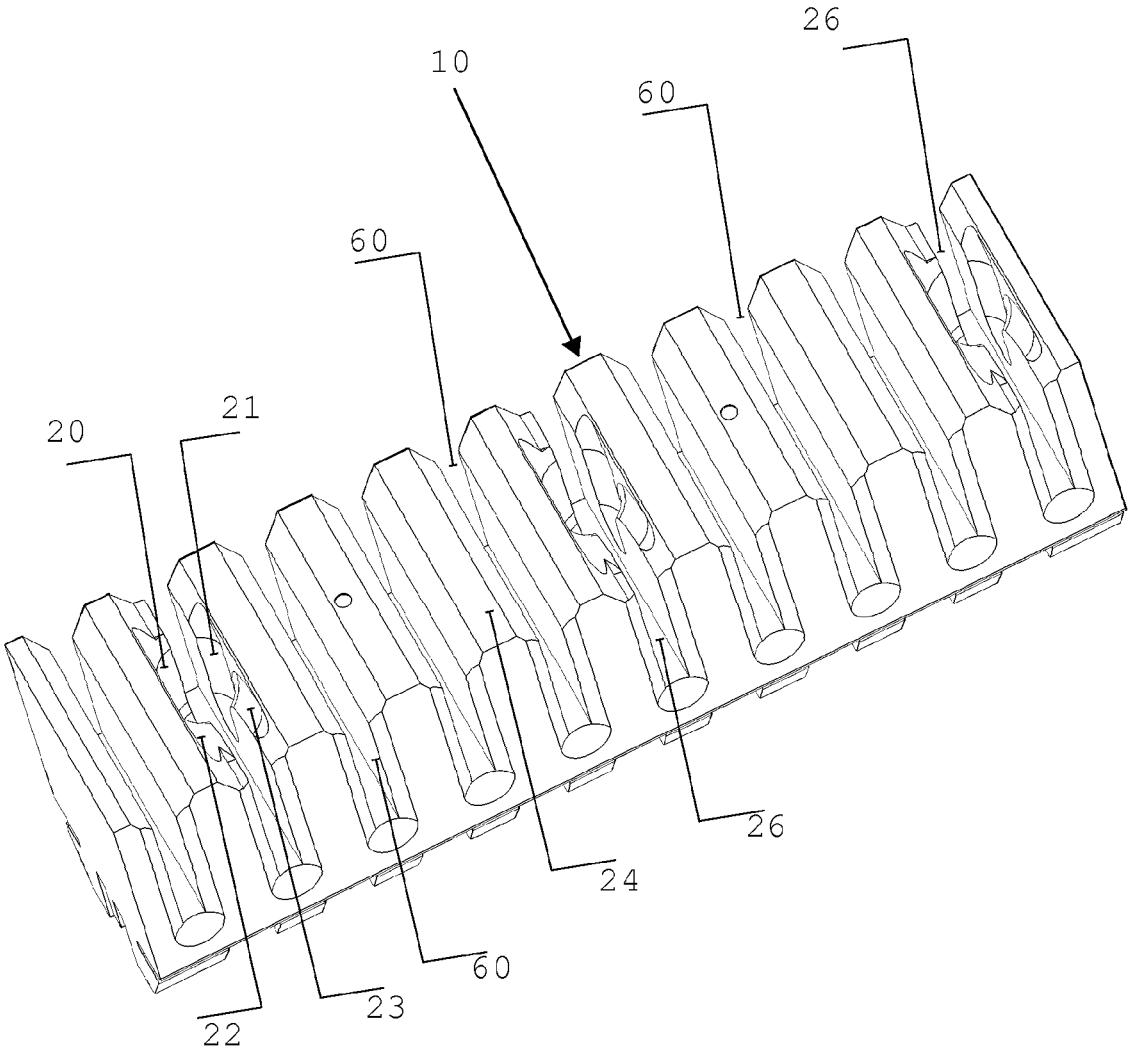
FIG. 6 is a Top Perspective View of the invention, illustrating a slat segment.

In FIG. 4 a flat cavity wall 40 of the slat segment 10 is shown. Each segmented slat 10 may be pre-configured with a specific quantity of cavities 26 (FIG. 1), and a specific quantity of blank cavities 60 (FIG. 6). The quantity of products to be dispensed into each container is controlled by both the total number of bifurcated cavities 26 installed in the packaging machine, along with the total number of blank cavities 60 configured in each slat segments 10. Each cavity includes an involute cavity entry 21 and an involute cavity exit 23 that facilitate entry into the bifurcated cavity 26 and exit from the bifurcated cavity 26 of discrete product units. A thermal radiation web 34 is shown, along with a stabilization pin 36.

During the operation of a packaging apparatus which utilizes the invention, the slat segments 10 may be rotating continuously. Pharmaceutical, vitamin, or food products 96 ready for packaging are deposited into the intake flutes 20 of the slat segment 10.

Figure 2:
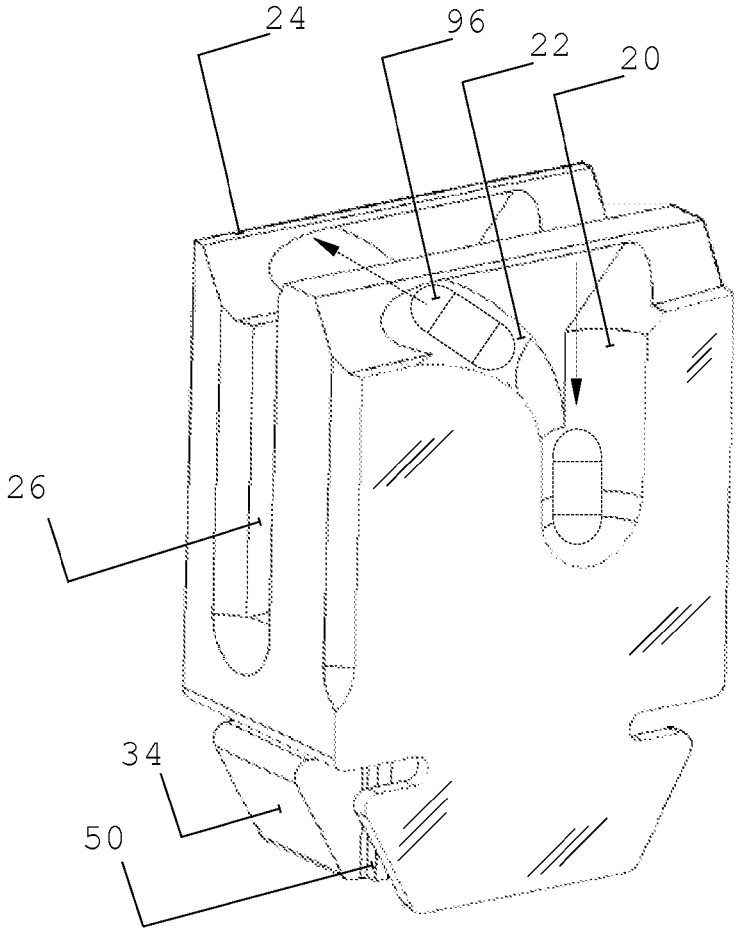
FIG. 2 is a Perspective Sectional View of the invention, illustrating a slat segment.

In FIG. 2 is illustrated a perspective sectional view of a slat segment 10. Contoured intake flutes 20 guide the pharmaceutical, vitamin, or food products 96 into the bifurcated cavities 26 within the slat segment 10, so that each bifurcated cavity 26 will hold one product. A thermal radiation web 34 is shown. A rigid reinforcing rib 50 runs vertically along the adjacent wall 24 to provide additional strength and stability to the slat segment 10.

When the correct numbers of bifurcated cavities 26 have been filled with products 96, the products 96 are then dispensed from the slat segment 10 via contoured disposal flutes 22 connected to each bifurcated cavity 26. The products 96 are eventually deposited into containers being conveyed proximate a packaging apparatus. Each container thereby receives a predetermined quality and quantity of pharmaceuticals, vitamin, or food products.

Figure 5:
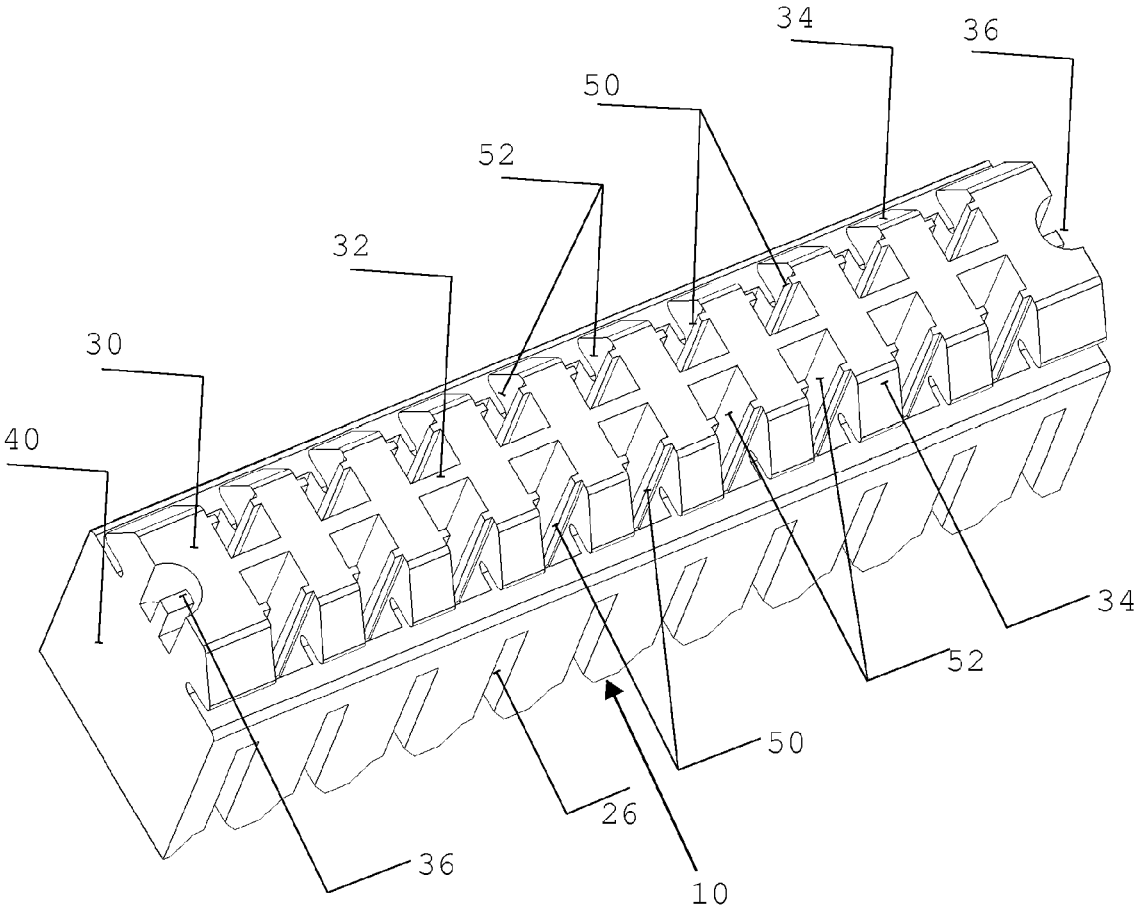
FIG. 5 is a Bottom Perspective View of the invention, illustrating a slat segment.

In FIG. 5, pluralities of adjacent, salient, substantially solid thermal radiation blocks 30 are arranged along a second surface of the slat segment 10. A plurality of bifurcated cavities 26 extend along the first surface of the segmented slat 10. The distal ends of each substantially solid thermal radiation block 30 comprise a thermal radiation web 34, which facilitates conduction of thermal radiation away from the slat segment 10. In one embodiment of the invention, the thermal radiation webs 34 are substantially trapezoidal in shape to provide maximum thermal conductivity and rigidity.

Each substantially solid thermal radiation block 30 is laterally connected to an adjacent substantially solid thermal radiation block 30 by a thermal radiation rib 32. Thermal radiation grooves 52 run vertically along the wall of each substantially solid thermal radiation block 30, thereby increasing thermal radiation and allowing the entire structure of the slat segment 10 to cool rapidly, and maintain dimensional stability. Rigid reinforcing ribs 50 run vertically along the wall 24 of each substantially solid thermal radiation block 30 to provide additional strength and stability to the slat segment 10. A stabilization pin 36 extends from the first end of the slat segment 10.

FIG. 6 illustrates a top perspective view of a slat segment 10. Extending along a first surface of the slat segment 10 are the bifurcated cavities 26 separated by adjacent walls 24. Each bifurcated cavity 26 includes an involute cavity entry 21 and an involute cavity exit 23 that facilitate entry into the bifurcated cavity 26 and exit from the bifurcated cavity 26 of discrete product units. In some embodiments of the invention 10, blank cavities 60 may be configured in the slat segment 10 for controlling the total number of bifurcated cavities 26 in the slat segment 10.

Figure 7:
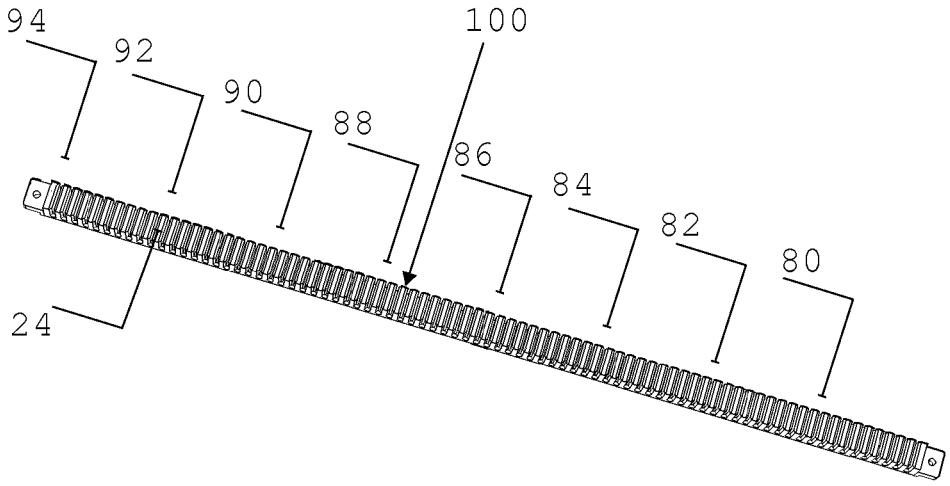
FIG. 7 is a Top Perspective View of the invention, illustrating a complete segmented slat.

In one embodiment of the invention, shown in FIG. 7, a plurality of slat segments 80, 82, 84, 86, 88, 90, 92 are connected longitudinally into one combined segmented slat 100 by stabilization pins 36 (FIG. 1) extending from the first and second ends of the slat segments 80, 82, 84, 86, 88, 90, 92. In this embodiment each slat segment 10 contains approximately ten bifurcated cavities 26 (FIG. 1).

Figure 8:
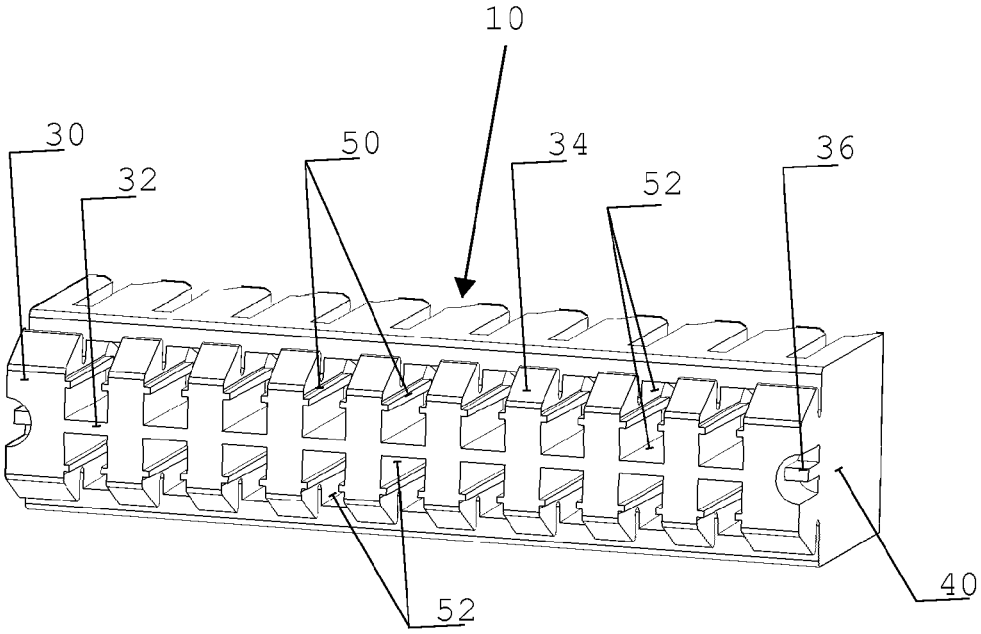
FIG. 8 is a Bottom Orthogonal View of the invention, illustrating a slat segment.

FIG. 8 illustrates a bottom orthogonal view of a slat segment 10. Pluralities of adjacent, salient, substantially solid thermal radiation blocks 30 are arranged along a second surface of the slat segment 10. The distal ends of each substantially solid thermal radiation block 30 comprise a thermal radiation web 34, which facilitates conduction of thermal radiation away from the slat segment 10. In one embodiment of the invention, the thermal radiation webs 34 are substantially trapezoidal in shape to provide maximum thermal conductivity and rigidity. Each substantially solid thermal radiation block 30 is laterally connected to an adjacent substantially solid thermal radiation block 30 by a thermal radiation rib 32. Thermal radiation grooves 52 run vertically along the wall of each substantially solid thermal radiation block 30. Rigid reinforcing ribs 50 run vertically along the wall 24 of each substantially solid thermal radiation block 30 to provide additional strength and stability to the slat segment 10. A stabilization pin 36 extends from the first end of the slat segment 10.

In yet other embodiments of the invention, the slat segments 10 may be comprised of polyethylene, ultra high molecular weight polymer (UHMW), aluminum, steel, or glass.

While a particular form of the invention 10 has been illustrated and described, it will be apparent that various modifications can be made without departing from the spirit and scope of the invention 10. For example, the shape and quantity of segmented slats 10 or bifurcated cavities 26 could be adjusted to various values. Accordingly, it is not intended that the invention be limited, except as by the appended claims.

That which is claimed is:

1. A slat segment comprising:

an elongated bar having a first end and a second end, wherein said elongated bar is straight having a single axis between said first end and said second end;

a plurality of discrete, bifurcated cavities within said elongated bar extending longitudinally along a first surface of said elongated bar;

a plurality of walls separating said bifurcated cavities, extending along said first surface of said elongated bar;

a plurality of adjacent, substantially solid thermal radiation blocks extending longitudinally along a second surface of said elongated bar;

whereby discrete pharmaceutical, vitamin, or food products may be conveyed into and then dispensed from said cavities into containers, and whereby thermal radiation is conducted away from said elongated bar.

2. The slat segment of claim 1 wherein each said bifurcated cavity further comprises:

an intake flute;

a dispensing flute;

a receptacle configured to receive a discrete capsule;

a slot configured to allow an external raking mechanism to sweep the contents of said bifurcated cavity:

and wherein said intake flute and said dispensing flute connect to said receptacle.

3. The slat segment of claim 2 wherein each said intake flute comprises a contoured channel, and wherein each said dispensing flute comprises a contoured channel, and wherein each said receptacle is substantially cylindrical.

4. The slat segment of claim 1 wherein the distal surfaces of said thermal radiation blocks comprise thermal radiation webs.

5. The slat segment slat of claim 4, wherein said thermal radiation webs are substantially trapezoidal in shape.

6. The slat segment of claim 1 wherein the vertical wall of each said thermal radiation block is laterally connected to the vertical wall of each adjacent thermal radiation block by a thermal radiation rib.

7. The slat segment of claim 1, wherein rigid reinforcing ribs run vertically along the wall of each said thermal radiation block.

8. The slat segment of claim 1, wherein thermal radiation grooves run vertically along the wall of each said thermal radiation block.

9. The slat segment of claim 1, wherein the first and second ends of said slat segment further comprise stabilization pins configured to stabilize said slat segment's connection to an adjacent slat segment.

10. A segmented slat comprised of a plurality of discrete slat segments connected longitudinally at their first and second ends, wherein each said slat segment comprises:

an elongated bar having a first end and a second end, wherein said elongated bar is straight having a single axis between said first end and said second end;

a plurality of discrete, bifurcated cavities within said elongated bar extending longitudinally along a first surface of said elongated bar;

a plurality of walls separating said bifurcated cavities, extending along said first surface of said elongated bar;

a plurality of adjacent, substantially solid thermal radiation blocks extending longitudinally along a second surface of said elongated bar;

a means of attaching longitudinally the said ends of each said slat segment to the said ends of another slat segment;

whereby discrete pharmaceutical, vitamin, or food products may be conveyed into and then dispensed from said cavities into containers, and whereby thermal radiation is conducted away from said elongated bar.

11. A segmented slat comprised of a plurality of slat segments connected longitudinally at their first and second ends, wherein each said slat segment is comprised of:

an elongated bar having a first end and a second end, wherein said elongated bar is straight having a single axis between said first end and said second end;

a plurality of discrete cavities within said elongated bar extending longitudinally along a first surface of said elongated bar, wherein each said cavity is comprised of an intake flute, a dispensing flute, and a substantially cylindrical receptacle, and wherein said intake flute and said dispensing flute are both comprised of contoured channels, and wherein said intake flute and said dispensing flute both connect to said cylindrical receptacle;

a plurality of walls, which separate said cavities, extending along said first surface of said elongated bar;

a plurality of adjacent salient thermal radiation blocks arranged longitudinally along said second surface of said elongated bar, and wherein the distal surfaces of said thermal radiation blocks comprise thermal radiation webs, and wherein the vertical wall of each said thermal radiation block is laterally connected to the vertical wall of each adjacent thermal radiation block by a thermal radiation rib, and wherein rigid reinforcing ribs run vertically along the wall of each said thermal radiation block, and wherein thermal radiation grooves run vertically along the wall of each said thermal radiation block, and wherein said thermal radiation webs are substantially trapezoidal in shape;

a means of attaching longitudinally the said ends of each said slat segment to the said ends of another slat segment;

whereby discrete pharmaceutical, vitamin, or food products may be conveyed into and then dispensed from said cavities into containers, and whereby thermal radiation is conducted away from said elongated bar.

* * * * *